US009870662B2

(12) United States Patent
Mullane et al.

(10) Patent No.: US 9,870,662 B2
(45) Date of Patent: Jan. 16, 2018

(54) WIRELESS LOCK SENSORY DELIVERY AND CONTROL DEVICE, SYSTEM AND METHOD

(71) Applicants: Tristan Mullane, Port Orange, FL (US); Ivan Foti, Hong Kong (CN)

(72) Inventors: Tristan Mullane, Port Orange, FL (US); Ivan Foti, Hong Kong (CN)

( * ) Notice: Subject to any disclaimer, the term of this patent is extended or adjusted under 35 U.S.C. 154(b) by 0 days.

(21) Appl. No.: 14/883,396

(22) Filed: Oct. 14, 2015

(65) Prior Publication Data

US 2017/0109953 A1 Apr. 20, 2017

Related U.S. Application Data

(60) Provisional application No. 62/064,426, filed on Oct. 15, 2014.

(51) Int. Cl.

| | |
|---|---|
| ***E05B 45/06*** | (2006.01) |
| ***G07C 9/00*** | (2006.01) |
| ***G08B 25/00*** | (2006.01) |
| ***G08B 25/08*** | (2006.01) |

(52) U.S. Cl.

CPC ..... *G07C 9/00309* (2013.01); *E05B 45/06* (2013.01); *G08B 25/008* (2013.01); *G08B 25/08* (2013.01); *G07C 2009/00825* (2013.01); *G07C 2009/00841* (2013.01)

(58) Field of Classification Search

CPC ..... G07C 9/00309; G07C 2009/00769; G07C 25/009; G07C 2009/00825; G07C 2009/00841; E05B 45/06; E05B 39/00; E05B 47/00; E05B 65/0894; G08B 25/008; G08B 25/08

USPC ..... 340/542, 546, 568.1, 539.31, 539.1

See application file for complete search history.

(56) References Cited

U.S. PATENT DOCUMENTS

| | | | | |
|---|---|---|---|---|
| 7,010,268 | B2 | 3/2006 | Chen | |
| 8,204,436 | B2 | 6/2012 | Bang | |
| 8,482,411 | B1 * | 7/2013 | Brown | E05B 45/005 340/539.31 |
| 8,855,562 | B2 | 10/2014 | Rajaraman | |
| 9,000,917 | B1 * | 4/2015 | Meyers | G08B 26/007 340/539.31 |

(Continued)

*Primary Examiner* — Anh V La

(57) ABSTRACT

The invention discloses a wireless lock sensory delivery and control device, system and method comprising a wireless lock and alarm connected to and controlled by Bluetooth connection to a remote device such as a cell phone, tablet, computer or PDA. The lock and alarm can be adjusted by the user remotely through the remote device, to control and modulate functions including alarms, sirens or other sound emitters; shock and movement sensors; lights; global positioning system (GPS) location and tracking components; battery strength detection components; alarm and lock testing and diagnostic feedback mechanisms; registration and warranty monitors; and data collection and storage components. The functionality can be further expanded by adding optional accessories which include but are not limited to additional GPS modules, boosters or range extenders, ancillary external alarms, lighting systems, cameras or other subsystems capable of responding to a wireless signal, and these accessories can be attached directly to the locked device, structure or vehicle and connected to the alarm system automatically upon arming the system.

18 Claims, 1 Drawing Sheet

(56) References Cited

U.S. PATENT DOCUMENTS

| | | | | |
|---|---|---|---|---|
| 2009/0231132 | A1* | 9/2009 | Shoenfeld | A61B 50/10 340/542 |
| 2013/0036781 | A1* | 2/2013 | Hartmann | E05B 39/00 70/431 |
| 2013/0335222 | A1* | 12/2013 | Comerford | G08B 13/06 340/542 |
| 2014/0150502 | A1* | 6/2014 | Duncan | G07C 9/00309 70/20 |
| 2015/0077252 | A1* | 3/2015 | King | G08B 13/06 340/542 |

* cited by examiner

WIRELESS LOCK SENSORY DELIVERY AND CONTROL DEVICE, SYSTEM AND METHOD

CROSS-REFERENCE TO RELATED APPLICATIONS

This application claims the benefit of U.S. Provisional Application No. 62/064,426, filed Oct. 15, 2014.

STATEMENT REGARDING FEDERALLY SPONSORED RESEARCH/DEVELOPMENT

Not applicable.

REFERENCE TO SEQUENCE LISTING, A TABLE, OR COMPUTER PROGRAM LISTING COMPACT DISC APPENDIX

Not applicable.

BACKGROUND OF THE INVENTION

This invention relates to locking mechanisms and alarms. More specifically, it discloses a device, system and method for activation, sensory feedback and control of mechanical locks and corresponding alarm functionality. Conventional mechanical lock components are integrated with low energy transceiver capacity to expand function and wireless control of lock and alarm protection.

DESCRIPTION OF THE RELATED ART

Related art for this invention includes devices for remotely locking or unlocking objects or structures, as well as methods for controlling Bluetooth devices through portable controllers.

Bluetooth controlled locks exist in commerce. There are keyless systems for structures, Bluetooth padlocks, and lock fobs that can be programmed with basic lock activation functions. However, the existing related art provides limited functionality. They can provide simple opening/closing functions, and in some cases motion sensors. In general, the existing related art also fails to provide a Bluetooth controlled lock that has sufficient mechanical strength to deter theft from higher cost articles such as motorcycles, boats, etc. More specifically, the related art does not provide functionality to modulate sensitivity for use in various environments, or to set and reset or change the volume of the alarm or siren. The present invention also provides GPS tracking, feedback on operation, the ability to extend range, lighting controls, and other sensitivity delivery and control functions which have not been previously made, used or disclosed.

An additional advantage that this device, system and method has over related art is that by utilizing Bluetooth technology, alarm and other functional circuitry can be minimized. It enables wireless operation as well as remote control. By reducing the quantity of circuitry components, the device and system can be made and therefore sold more economically, reducing cost.

SUMMARY OF THE INVENTION

The invention incorporates low energy radio transceivers (BLE) within a conventional mechanical lock system. The device comprises a heavy-duty mechanical lock; a module within said lock which includes low-energy radio transceivers integrated with a printed circuit board or microcontroller board capable of communication with external functionality components; one or more power source(s); and a mobile device link such as Bluetooth or other low energy radio transceiver. The device is remotely actuated, controlled and adjusted by the user through a mobile device link by a remote device, such as a cell phone, PDA, computer, tablet, Bluetooth wristwatch, or other connectable remote sources for data and information.

Alternate embodiments of the mechanical lock components include but are not limited to a barrel and key type, or a coded lock; the invention contemplates various conventional mechanical locking means. These conventional mechanical components are enhanced by the inclusion of electronic components in the form of a module within a lock body designed to communicate with an alarm system that allows programmable functions. The electronic module includes, but is not limited to, a printed circuit board (PCB) or microcontroller board capable of associating with the alarm system and other components, transceiver, shock and movement sensors, a siren or sound emitter, and a primary power source. Optionally, other external associated electronic components can include but are not limited to a sub-module for use with a global positioning system and a sub-module for connecting to a wireless communications network, a secondary power source, lighting systems, range extenders, external alarms, security cameras, and devices for communications with ancillary locks. The printed circuit board comprises a wireless transceiver, basic microprocessor functionality, and an accelerometer.

In a preferred embodiment, the invention incorporates a method of use that includes a mobile communication device such as a cell phone or tablet to interface with and remotely command the various functions of the alarm system. The mobile device provides a means to remotely control the alarm system, and can be programmed to effectuate a wide variety of functions. The various functions of this alarm system include but are not limited to such capabilities as arming and disarming the alarm; modifying the volume of the alarm, siren or noise-emitting device; altering the sensitivity of the shock or movement sensors, or changing the length of time or duration that the alarm will continue to emit noise. An optional external GPS module and module for connecting to a wireless communications network may be incorporated to provide regular, discrete transmissions containing location data and to communicate this data over a wireless network such as an established cell phone tower network. Additionally, it provides the ability to deliver remote instrument functionality support, feedback and diagnostics from a web interface the user can readily access. A primary power source will power the internal electronic components as well as provide power to the alarm either indirectly through the PCB or directly with a separate power attachment. A secondary power source will supply the optional GPS module. A preferred embodiment utilizes a standard battery; one skilled in the art would appreciate that other power sources, such as but not limited to capacitors, solar power components or other alternative energy generation and storage devices could also be used.

The invention disclosed allows users to interactively set and reset custom settings for use in various locations and environments. These include but are not limited to such settings as city, village, garage, and day/nighttime. The system is capable of automatic adjustment of these parameters consistent with the location and environment in which it is used. This is useful because in noisier areas or those with more motion, such as a city street, the sensitivity of the system could be reduced to minimize accidental triggering of the alarm or siren functions.

The use of wireless communications technology allows the lock system to be connected to, or network with, external functionality components that comprise alarms, sirens or other sound emitters; shock and movement sensors; lights; global positioning system (GPS) location and tracking components; battery strength detection components; alarm and lock testing and diagnostic feedback mechanisms; registration and warranty monitors; and data collection and storage components. Accessories such as GPS modules, boosters or range extenders, ancillary external alarms, lighting systems, cameras or other subsystems capable of responding to a wireless signal can be optionally added. These accessories can be attached directly to the locked device or vehicle and connected to the alarm system automatically upon arming the system.

In one embodiment, the invention disclosed includes a method of providing feedback and technical support to users of a lock device wherein a text, email or phone message can be sent to the user if the alarm is triggered, and the locked object, vehicle or structure can be tracked in real time.

The invention disclosed herein can be further explained through a discussion of its objects and related functions.

An object of the invention is to allow a user to connect to the alarm module within the lock to tailor calibration of the sensors, thereby adjusting sensitivity of the alarm. Active filtering can also enhance the ability of the system to prevent false alarms. For example, background noise and vibration from fast moving traffic could be filtered out, reducing or eliminating alarm triggering as a result of unintentional or unavoidable background activity. Feedback from the module or from user input at the mobile or remote interface allows the user to modify the settings of the system for steady-state or reprogrammed performance of the system's functionality, allowing for continued use if the settings are working or modification of the settings based on the feedback provided.

Another object of the invention is to allow modulation of the volume, duration, and sound characteristics of the alarm and siren. One example of this functionality is to make the siren progressively louder or longer upon subsequent triggering of the alarm to minimize undue disturbance while maximizing protection from the threat of theft or tampering. Another function consistent with this object is to provide different siren sounds for personalization or differentiation of the alarm.

A different object of the invention is to provide a user with the ability to remotely set (arm or disarm) or trigger the alarm, and to adjust alarm activation delay (the time before the alarm goes off after detecting shock or movement), and separately to adjust the alarm activation time before rest (the time the alarm sounds before reset).

A further object of the invention is to allow data collection and storage by an application program or software from the modules within the device to monitor such components as battery strength and reserve, alarm dates and log, and provide self-testing and diagnostics of the lock and alarm system. Such data collection and storage also provides a means for tracking serial number and warranty status of the lock system, automatic registration and warranty monitoring for customers. By generating reports or data providing feedback and technical support to users of a lock device, which includes sending or reception of a text, email or phone message which is sent to the user if the alarm is triggered, a means for the locked object, structure or vehicle to be tracked in real time is provided.

It is also an object of the invention to provide a lock and remotely activated and controlled alarm system for bicycles, motorbikes, scooters, boats, airplanes, motor vehicles or other motorized vehicles and other two- and three-wheeled or non-automobile vehicles to prevent theft or tampering.

A separate, further object is to provide an alarm and method for a remotely activated and controlled alarm system for use with a compatible conventional padlock or U-lock. Examples of applicability of this device and method include but are not limited to use on doors, windows, buildings, sheds, storage areas, and other structures or structural components, storage units, commercial or industrial equipment, gates, shipping or storage containers, or toolboxes.

Each of the foregoing objects and functions are effectuated and controlled individually by the user through use of a wireless communications network. Individually operated and commercially available devices such as, but not limited to cell phones, tablets, and PDA's will be appropriate for this connection and can be activated through software or application downloads. The use of low energy radio transceiver (BLE) technology provides an interface between the lock, its alarm and siren components and the user's own personal communication device.

All patents, patent applications, provisional patent applications and publications referred to or cited herein are incorporated by reference in their entirety to the extent they are not inconsistent with the teachings of the specification.

DESCRIPTION OF THE REFERENCE NUMBERS

10 Bluetooth communication protocol
20 Wireless communications network
30 Bluetooth connected device
40 Microcontroller board (PCB)
50 Lock transceiver
60 Sensors
70 Global Positioning System (GPS) module
80 Alarm module
90 Secondary power source
100 Primary power source
110 GPS incoming location data

DESCRIPTION OF THE FIGURES IN THE DRAWINGS

DETAILED DESCRIPTION

Figure 1:
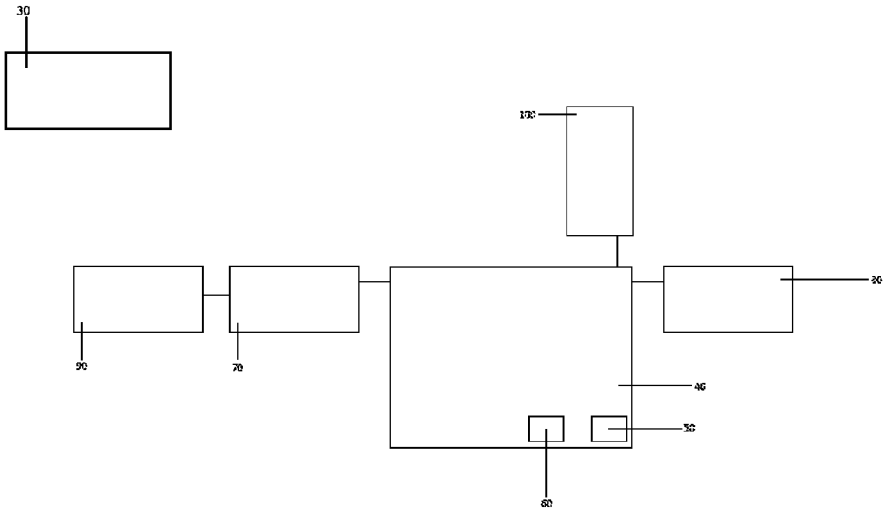
FIG. 1 depicts a schematic diagram of the physical system or hardware.

The invention disclosed is more fully understood by reference to the Figures in the drawings. FIG. 1 shows a schematic diagram of the physical system or hardware. The microcontroller board 40, which is located within the body of the Bluetooth lock, includes a lock transceiver 50 and sensors 60 which can detect motion and/or sound. Disturbances to the lock system, such as movement or tampering with the system, trigger an alarm and its associated siren, together the alarm module 80, which deters theft or unwanted contact. An optional GPS module 70 including GSM/GPS/Bluetooth can be integrated with the lock system to communicate location data and can send information to and from a Bluetooth lock when the user or lock is out of range. This module can be powered by a secondary power source 90 that is also capable of backing up a primary power source 100 which powers the system. Wireless control of the alarm module 80 and sensors 60 through the use of a Bluetooth-enabled and connected device 30 allows for a variety of functions, including but not limited to sensitivity adjustment of the sensors 60 and sound modulation of the alarm module 80.

Figure 2:
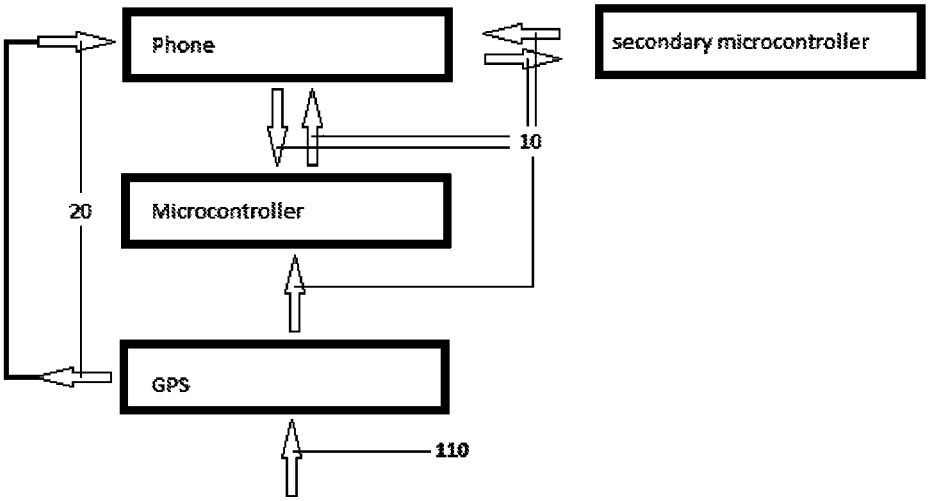
FIG. 2 depicts a flow diagram showing inter-connectivity of the system.

FIG. 2 depicts a flow diagram showing inter-connectivity of the system setting forth the best mode for carrying out the invention and its method of use. The Bluetooth lock is equipped with a module which includes a lock transceiver 50 located on the microcontroller board 40 within the lock. Because it is contained within the lock, the module is protected from tampering, disarming, weather or other physical compromise. The lock transceiver 50 is capable of integration with and provides a means for communication between the lock hardware, including but not limited to the alarm module 80, sensors 60 and optional GPS module 70. The lock transceiver 50 which is on board the PCB/Microcontroller 40 shares a 2-way communication link via Bluetooth with an external device to control lock system functions, report lock status, and provide trouble-shooting capability. This link using Bluetooth communication protocol 10 between the lock transceiver 50 and an external Bluetooth connected device 30 is illustrated. The external device and GPS device link utilizes a wireless communications network 20 that allows for communication of commands and information between the lock system and one or more external functionality components. The GPS module 70 incoming location data 110 allows the unit to receive location data from existing global positioning satellites. The Bluetooth device transceiver can also communicate information to another microcontroller 40 from the GPS module. This way, Bluetooth enabled and connected devices can send information to and from Bluetooth integrated locks when the user or lock is out of range. Multiple and various Bluetooth-connected devices can send information to the lock transceiver 50 to effectuate commands. The GPS module 70 can communicate to transmit information to and from a lock transceiver 50, as well as other connected Bluetooth devices such as a secondary microcontroller through Bluetooth communications protocol 10.

This invention also contemplates a method of use for a wireless lock control system. A standard, mechanical lock equipped with a module containing a Bluetooth or low energy radio transceiver (BLE) is actuated, adjusted and controlled by a user with a remote communications device. The user (1) downloads the software onto a mobile device; (2) mechanically closes the lock; (3) activates the alarm system wirelessly through the application on the mobile device; and (4) interacts with and modulates the functions of the lock and alarm systems by using a link to access the software and associated controls on the mobile device.

While the description above discloses preferred embodiments of the present invention, it is contemplated that variations and modifications of the invention are possible and are considered to be within the scope of the claims that follow.

The invention claimed is:

1. A mechanical lock and alarm system for locking and remotely controlling the sensitivity and operative features of the lock and alarm system comprising:

a. a heavy-duty mechanical lock capable of securing an object or structure;

b. an integrated module within said mechanical lock, further comprising low-energy radio transceivers actuated by a printed circuit board or microcontroller board capable of communication with external functionality components;

c. one or more power source(s); and d. a downloadable application (app) for computer or mobile devices which connects to the locking mechanism via Bluetooth or low energy radio transceiver mobile link and controls functionality components connected to said lock and alarm system; said app provides a link from the lock and alarm system to the functionality controls to:

i. respond to sensory inputs from surrounding environmental conditions;

ii. provide an alert signal to a user; and iii. modulate performance of the lock and alarm system including sensitivity of the locking mechanism or volume and length of the alarm, based on user input from a remote device, including a cell phone, PDA, computer, tablet, Bluetooth wristwatch, or other connectable remote sources for data and information.

2. The system of claim 1 wherein said mechanical lock comprises padlocks, barrel locks, dead locks, U-locks, key type, or coded lock and other similar lock types.

3. The system of claim 1 wherein said external functionality components comprise alarms, sirens or other sound emitters; shock and movement sensors; lights; global positioning system (GPS) location and tracking components; battery strength detection components; alarm and lock testing and diagnostic feedback mechanisms; registration and warranty monitors; and data collection and storage components.

4. The system of claim 1 wherein said functionality can be further expanded by adding optional accessories which include additional GPS modules, boosters or range extenders, ancillary external alarms, lighting systems, cameras or other subsystems capable of responding to a wireless signal, and wherein said accessories can be attached directly to the locked device, structure or vehicle and connected to the alarm system automatically upon ing the system.

5. The system of claim 1 wherein said external functionality components include alarm, siren or other noise-emitting functions and sensitivity controls that can be turned on, off, extended in duration, or the volume can be changed by the user from said remote device.

6. The system of claim 1 wherein said module is configured within said lock, and is therefore protected from tampering, disarming, weather, or other physical compromise.

7. The system of claim 1 wherein said power source is a battery or electricity.

8. The system of claim 7 wherein said battery or said electricity is sourced from alternative energy including solar or other renewable sources.

9. The mechanical lock and alarm system of claim 1 wherein feedback from the module or from user input at the mobile or remote interface is capable of modifying the settings of said system for steady-state or reprogrammed performance of the system's functionality.

10. The mechanical lock and alarm system of claim 1 comprising a lock and an electronic alarm activated and controlled through a Bluetooth connection between the mechanical lock and alarm system and the remote device; said remote device comprises the cell phone, PDA, computer, tablet, Bluetooth wristwatch, or other connectable remote sources for data and information; said connection functions to enable remote operation from a mobile device and eliminate circuitry within the device; said mechanical lock is capable of adjustable, user defined external functionality including alarms, sirens or other sound emitters; shock and movement sensors; lights; global positioning system (GPS) location and tracking components; battery strength detection components; alarm and lock testing and diagnostic feedback mechanisms; registration and warranty monitors; and data collection and storage components.

11. The mechanical lock and alarm system of claim 1 wherein the functionality can be further expanded by adding optional accessories which include additional GPS modules, boosters or range extenders, ancillary external alarms, lighting systems, cameras or other subsystems capable of responding to a wireless signal, and wherein said accessories can be attached directly to the locked device, structure or vehicle and connected to the alarm system automatically upon arming the system and adjusted and controlled by the user remotely.

12. A method of locking objects or structures comprising the steps of:

a. Placing and physically locking a mechanical lock mechanism;
b. Connecting the mechanical lock mechanism with the system in claim 1 and powering up the system and the connected mechanism;
c. Connecting the mechanism components via Bluetooth connection with the remote device comprising the tablet, cell phone or other mobile device;
d. Positioning desired sensory and alarm or siren settings,
e. Activating the system;
f. Adjusting or changing the sensitivity and other settings to comport with the environmental conditions in the vicinity of said mechanical lock mechanism;
g. Generating reports or data from said mechanism components and providing this information to the user through said remote device.

13. The method of claim 12, wherein said objects include bicycles, motorbikes, scooters, boats, airplanes, motor vehicles or other motorized vehicles and other two- and three-wheeled or non-automobile vehicles and wherein said structures include doors, windows, buildings, sheds, storage areas, and other structures or structural components, storage units, commercial or industrial equipment, gates, shipping or storage containers, or toolboxes.

14. The method of claim 12 wherein adjusting or changing the sensitivity and other settings further includes configuration or reconfiguration of said lock mechanism and lock settings, comprising the additional steps of:

a. Downloading software capable of interaction with said lock mechanism on to the mobile device;
b. Powering on a module within the lock;
c. Connecting said module with said mobile device through Bluetooth connection;
d. Adjusting, configuring or setting the settings on said mobile device to effect user preferred control and functionality.

15. The method of claim 12 wherein generating reports or data providing feedback and technical support to users of a lock device further comprises the steps of downloading a mobile application and connecting the system wirelessly through said mobile application to facilitate sending or reception of a text, email or phone message which is sent to the user if the alarm is triggered, whereby the locked object, structure or vehicle can be tracked in real time.

16. The method of claim 12 further including actuating, through said settings, external functionality components comprising alarms, sirens or other sound emitters; shock and movement sensors; lights; global positioning system (GPS) location and tracking components; battery strength detection components; alarm and lock testing and diagnostic feedback mechanisms; registration and warranty monitors; and data collection and storage components; and wherein the functionality can be further expanded by adding optional accessories which include additional GPS modules, boosters or range extenders, ancillary external alarms, lighting systems, cameras or other subsystems capable of responding to a wireless signal, and wherein said accessories can be attached directly to the locked device, structure or vehicle and connected to the alarm system automatically upon arming the system.

17. A wireless lock sensory delivery and control device system comprising a wireless lock and alarm connected to and controlled by Bluetooth connection to a remote device comprising a cell phone, tablet, computer or PDA that can be adjusted by a user remotely through said remote device, to control and modulate functions including alarms, sirens or other sound emitters; shock and movement sensors; lights; global positioning system (GPS) location and tracking components; battery strength detection components; alarm and lock testing and diagnostic feedback mechanisms; registration and warranty monitors; and data collection and storage components; and wherein the functionality can be further expanded by adding optional accessories which include additional GPS modules, boosters or range extenders, ancillary external alarms, lighting systems, cameras or other subsystems capable of responding to a wireless signal, and wherein said accessories can be attached directly to the locked device, structure or vehicle and connected to the alarm system automatically upon arming the system.

18. The wireless lock sensory delivery and control device system of claim 17 wherein said device comprises said lock integrated with said alarm which can be controlled, adjusted and activated remotely via Bluetooth connection between said device and the cell phone, PDA, computer, tablet, Bluetooth wristwatch, or other connectable remote sources for data and information.

* * * * *